United States Patent [19]

Mita et al.

[11] 4,063,900

[45] Dec. 20, 1977

[54] PELLET TYPE CATALYTIC CONVERTER

[75] Inventors: Yasuhiro Mita, Higashi-yamato; Minoru Uchino, Yokohama; Masato Sasaki, Tokyo, all of Japan

[73] Assignee: Nissan Motor Company, Limited, Yokohama, Japan

[21] Appl. No.: 728,852

[22] Filed: Oct. 1, 1976

[30] Foreign Application Priority Data

Oct. 3, 1975 Japan ..... 50-118943

[51] Int. Cl.[2] ..... F01N 3/15; B01J 35/04

[52] U.S. Cl. ..... 23/288 F; 23/288 R; 52/473; 55/DIG. 30; 55/515; 55/518

[58] Field of Search ..... 23/288 R, 288FC; 55/DIG. 30, 518, 515; 60/299

[56] References Cited

U.S. PATENT DOCUMENTS

| | | | |
|---|---|---|---|
| 3,149,925 | 9/1964 | Scheitlin | 23/288 F |
| 3,818,667 | 6/1974 | Wagner | 23/288 F X |
| 3,838,977 | 10/1974 | Warren | 23/288 F |

FOREIGN PATENT DOCUMENTS

| | | | |
|---|---|---|---|
| 1,371,330 | 10/1974 | United Kingdom | 23/288 F |

*Primary Examiner*—James H. Tayman, Jr.
*Attorney, Agent, or Firm*—Bacon & Thomas

[57] ABSTRACT

A pellet casing is formed with concave louvers which cause volume reducing inward flexing of the casing when heated, and simultaneously provide low gas flow resistance therethrough.

7 Claims, 7 Drawing Figures

PELLET TYPE CATALYTIC CONVERTER

The present invention relates in general to a catalytic converter for catalytically treating the exhaust gases emitted from an internal combustion engine, and more particularly to a pellet type catalytic converter containing therein a plurality of catalytic pellets.

It is an object of the present invention to provide a pellet type catalytic converter which provides minimum flow resistance to the exhaust gases passing therethrough.

It is another object of the present invention to provide a catalytic converter having a catalytic pellet casing which is effectively unchanged in volume when heated, so that the catalytic pellets remain snugly packed in the casing during the operation of the converter.

It is still another object of the present invention to provide a catalytic converter for catalytically treating the exhaust gases emitted from an internal combustion engine, the converter including a container, exhaust gas inlet means at one end of the container, exhaust gas outlet means at the other end of the container, and catalytic pellet holding means supported within the container so that the exhaust gases from the inlet means pass through the holding means before reaching to the outlet means, which is characterized in that the catalytic pellet holding means comprises a casing provided at its walls with a plurality of louvers that extend inwardly toward the inside of the casing.

Other objects and advantages of the present invention will become apparent from the following detailed description when taken in conjunction with the accompanied drawings, in which.

Prior to explaining the construction of the pellet type catalytic converter according to the present invention, description of the conventional pellet type catalytic converter shown in FIG. 1 will be made in order to clarify the invention.

Figure 1:
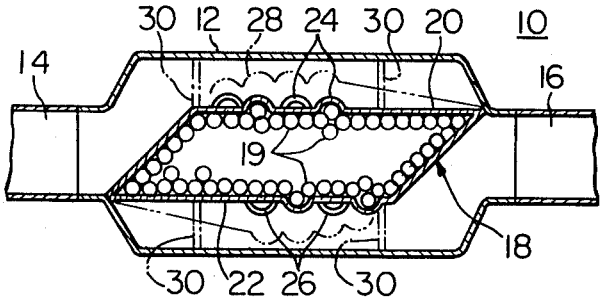
Fig. 1 PRIOR ART
FIG. 1 is a sectional view of a conventional pellet type catalytic converter.

In FIG. 1, the conventional converter 10 is shown to be disposed in an exhaust conduit system of an internal combustion engine (not shown) and generally comprises a container 12 having an exhaust gas inlet tube 14 at its upstream portion and an exhaust gas outlet tube 16 at its downstream portion. Within the container 12, a casing 18 is supported which contains or has packed therein a plurality of catalytic pellets 19. The casing 18 is formed at its upper and lower wall sections 20 and 22 with a plurality of louvers 24 and 26 for providing fluid communication between the interior of the casing 18 and the exterior of the casing 18. Thus, the exhaust gases coming from the engine through the inlet tube 14 pass through the interior of the casing 18 for catalytical treatment thereof before reaching to the outlet tube 16. Now, in this conventional converter 10, each of the louvers 24 and 26 is constructed to extend outwardly away from the casing 18, as shown.

With the construction of the conventional converter 10, however, the following several disadvantages will arise.

1. Since the louvers 24 extend outwardly from the casing 18, it is highly likely that some of the catalytic pellets 19 are just placed on or are otherwise received in the through holes defined by the respective louvers 24 and 26, so that the flow resistance of the converter 10 is greatly increased. This causes a high exhaust gas pressure or high back pressure with a result of poor fuel economy and poor engine performance.

2. When hot exhaust gases are fed into the container 12, the catalytic pellet casing 18 is subjected to a thermal expansion to increase the volume thereof as indicated in phantom lines 28 with a result that the catalytic pellets become loose in the casing 18. Subsequently, mutual abrasion of the pellets 19 produces ultrafine catalyst powder. Thus, the so-called secondary air-pollution problem arises.

3. If some retainers are provided in the container 12, as shown by phantom lines 30, for preventing the above-mentioned expansion of the casing 18, the flow resistance of the container 12 will increase by the provision of the retainers, acting, in this instance, as flow restrictors.

Therefore, the present invention is proposed to eliminate these drawbacks encountered in the conventional pellet type catalytic converter mentioned above.

Figure 2:
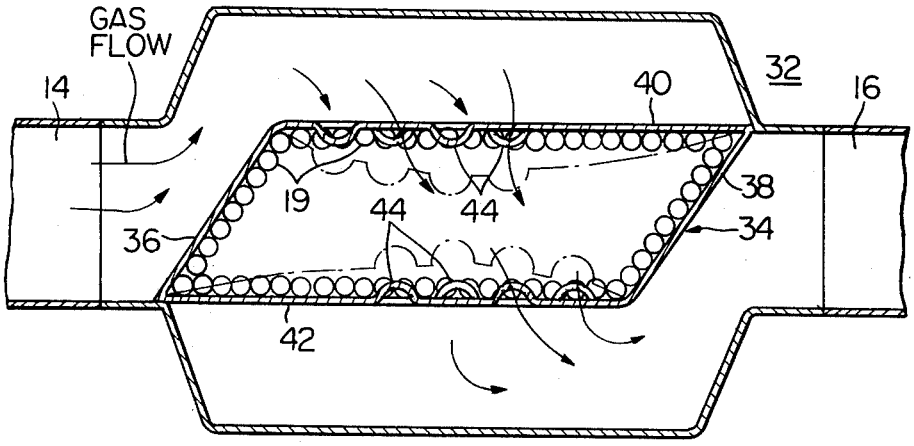
FIG. 2 is a sectional view of a pellet type catalytic converter, according to the present invention, having an improved catalytic pellet casing therein.

Referring to FIG. 2 of the drawings, there is shown a pellet type catalytic converter 32 according to the present invention, in which the converter 32 comprises generally same parts as in the case of the prior-mentioned conventional converter 10 except for an improved casing 34 containing the catalytic pellets 19. As shown, the improved casing 34 is formed in a parallelepiped shape and has a first pair of parallel spaced wall sections 36 and 38 respectively facing the inlet and outlet tubes 14 and 16, a second pair of parallel spaced wall sections (no numerals) sealingly covered with side wall portions of the container 12, and a third pair of parallel spaced wall sections 40 and 42 exposed to the main portion of the interior of the container 12. As seen, the wall sections 36 and 40 are positioned to be exposed to the exhaust gases coming from the engine (not shown) through the inlet tube 14. On the other hand, the wall sections 38 and 42 are positioned to be exposed to the catalytically treated gases passing to the outlet tube 16.

Now, it should be noted that, according to the invention, the third pair of parallel spaced wall sections 40 and 42 are formed with a plurality of louvers that extend inwardly toward the inside of the casing 34. These louvers are formed by pressworking the casing wall 42 (40) and each of the louvers comprises an elongated strip portion 44 having its longitudinal ends integrally attached to the wall of the casing, the strip 44 having a central unsupported portion passing directly over the opening **44*a* in the casing wall 42 (40), and projecting inwardly towards the inside of the casing to thereby define an opening through the wall 42 (40), the opening providing fluid communication between the interior of the casing 34 and the exterior of the casing 34. The louvers, conveniently referred to by the numeral 44 applied to the strip portion, are arranged parallel to the direction of flow of the exhaust gases admitted from the engine into the container 12 through the inlet tube 14**.

Figure 4:
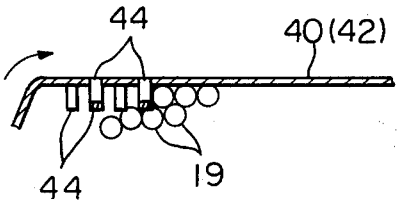
FIGS. 4, 5A and 5B are partial sectional views of other improved catalytic pellet casings respectively formed with several kinds of louvers.

However, if desired, the louvers 44 may be arranged perpendicularly to the flowing direction of the gases, as shown in FIG. 4.

Figure 3A:
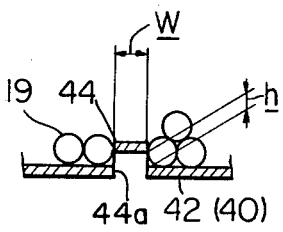
FIGS. 3A and 3B are enlarged views respectively showing the side view and the front view of a louver formed in the walls of the improved catalytic pellet casing illustrated in FIG. 2.
Figure 3B:
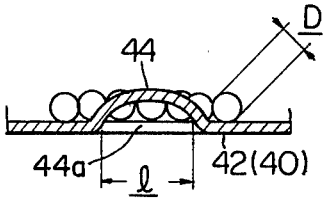

The detailed construction of each of the louvers 44 is shown in FIGS. 3A and 3B which respectively illustrate the sectional side view and the sectional front view of the louver 44. Preferably, the louver 44 is so constructed to satisfy the relationship $h < D$, $w, > D$ and $l > 2 . D$ where $h$, $w$ and $l$ respectively represent the maximum height and width of the louver strip 44, and the length of the opening 44*a*, and D represents the average diameter of the catalytic pellets 19.

With this arrangement, the converter of the present invention can eliminate the drawbacks of the conventional converter mentioned bofore. More specifically speaking, it is impossible that the catalytic pellets will be disposed on the through holes 44*a* in the casing defined by the louvers 44. Furthermore, the volume change of the casing does not occur even when the casing 34 is heated. This is because the inward movements of the wall sections 40 and 42, which movements normally would occur from expansion forces when the casing 34 is heated, are prevented by the provision of the packed catalytic pellets in the casing 34.

With respect to the arrangement and the form of the louvers of the casing 34, several modification and changes are possible in this invention. Some of these are shown in FIGS. 5A and 5B with the respective casings.

Figure 5A:
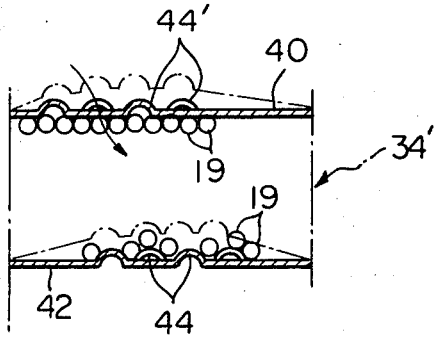

In FIG. 5A, the louvers 44' positioned at the wall section 40 exposed to the untreated gases coming through the inlet tube 14 are so formed to extend outwardly away from the casing 34', on the other hand, the louvers 44 on the wall section 42 exposed to the treated gases admitting into the outlet tube 16 are formed to extend inwardly toward the inside of the casing 34'. In this case, the volume of the casing 34' is unchangeable also even when the casing 34' is heated since both the wall sections 40 and 42 attempt to flex upwardly in the same direction when heated, and as shown in phantom lines 46. This means that the snug packing of the catalytic pellets 19 in the casing 34' will remain the same even when the casing 34' is heated and cooled alternatively during engine operation.

Figure 5B:
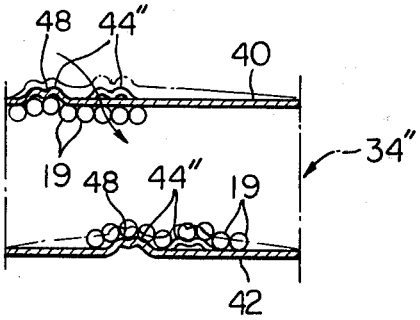

In FIG. 5B, each of the louvers 44'' positioned on the both of the wall sections 40 and 42 is formed at the middle portion thereof with a slight depression 48. In this case, the upward movements of the wall sections 40 and 42 can be considerably resticted in comparison with the case of FIG. 5A.

In addition to these illustrated several modifications and changes, it is also possible that the louvers are arranged to extend outward and inward from their corresponding wall sections 40 and 42 alternatively at regular intervals. With this construction, the flexure of the wall sections 40 and 42 due to the heat application will be stopped.

As a result of several experiments, it became clear that the flow resistances of the three kinds of converters respectively equipped with the prior-mentioned casings 34, 34' and 34'' are quite low. In reality, the flow resistances of these converters of the invention are about 60–70% of that of the conventional type. This will be more apparent from the Table 1 which shows differential pressure between the inlet tube 14 and the outlet tube 16 on the three kinds of converters of the invention and the conventional type.

Now, it will be appreciated that the formation of the louvers in the casing must be made by taking into due consideration both the differential pressure provided by the subject converter and the effectiveness of the catalytic pellets contained in the casing.

Although, the present invention has shown a few embodiments, it will be obvious to those skilled in the art that is not so limited, but is susceptible to various other changes and modifications without departing from the spirit thereof.

TABLE 1

| Varieties of Converters | Form of Pellet Casing | Differential Pressure (ΔP) Observed Value (gr/cm²) | Differential Pressure (ΔP) Ratio of Present Invention to Prior Art |
|---|---|---|---|
| Conventional Converter of FIG. 1 | 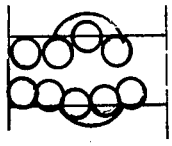 | 59.2 | — |
| Converter with the Casing of FIG. 2 | 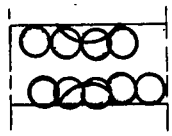 | 34.2 | 0.58 |
| Converter with the Casing of FIG. 5A | 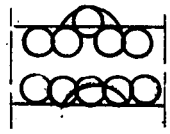 | 42.0 | 0.71 |
| Converter with the Casing of FIG. 5B | 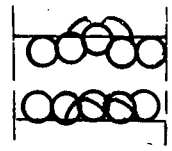 | 36.5 | 0.62 |

What is claimed is:

1. In a catalytic converter for catalytically treating the exhaust gases emitted from an internal combustion engine, including a container, exhaust gas inlet means at one end of said container, exhaust gas outlet means at the other end of said container, and a catalyst pellet casing supported within said container and having on at least a part of its wall portions a plurality of louvers defining respective openings through the said part of the wall portions which provide fluid communication between the interior and the exterior of said casing and allow the exhaust gases from said inlet means to pass through the interior of said casing to said exhaust gas outlet means, said casing being packed with a plurality of catalyst pellets, the improvement comprising:

each of said louvers comprising an elongated strip portion having its longitudinal ends integrally attached to said wall portion and a central unsupported portion projected toward the inside of said casing while crossing directly over the corresponding louver opening, whereby when said casing is heated, the louvered wall portions will tend to curve due to expansion forces toward the inside of said casing.

2. A catalytic converter as claimed in claim 1, in which the catalyst pellets have an average diameter D, and in which each of said louvers is constructed to satisfy the relationship $h < D$, $w > D$ and $l \geqq 2 . D$ where $h$, $w$, and $l$ respectively represent the maximum height of the unsupported portion of said strip from the casing wall, the width of the strip, and the length of the louver opening through the wall of the casing, the width of each of said louver openings through the wall of the casing corresponding substantially with the width of said strips.

3. A catalytic converter as claimed in claim 2, in which said louver openings extend generally parallel to the flowing direction of the exhaust gases through the container.

4. A catalytic converter as claimed in claim 2, in which said louver openings extend generally perpendicularly to the flowing direction of the exhaust gases through the container.

5. A catalytic converter as claimed in claim 1, in which the said central portion of each of said strip portions includes a section bent back toward the casing wall so that the strip in longitudinal cross section is generally W-shaped.

6. A catalytic converter as claimed in claim 2, wherein the unsupported portion of the strip portion of each louver is generally uniformly arcuatly curved.

7. In a catalytic converter for catalytically treating the exhaust gases emitted from an internal combustion engine, including a container, exhaust gas inlet means at one end of said container, exhaust gas outlet means at the other end of said container, a catalyst pellet casing supported within said container, said casing being packed with a plurality of catalyst pellets and formed into a parallelpiped shape consisting of a first pair of parallel spaced wall sections respectively facing the inlet and outlet means, a second pair of parallel spaced wall sections sealingly covered with side wall portions of said container, and a third pair of parallel spaced wall sections exposed to the main portion of the interior of said container, one of said third pair of parallel spaced wall sections being exposed to the exhaust gases coming from said inlet means and the other one of said third pair of parallel spaced wall sections being exposed to the exhaust gases admitting into said outlet means, and a plurality of louvers defining respective openings formed in said pellet casing for providing a fluid communication between the interior and the exterior of said casing thereby allowing the exhaust gases from the inlet means to pass through the interior of said casing before reaching said outlet means, the improvement comprising:

all of said louvers being formed in said third pair of parallel spaced wall sections, and each of said louvers comprising an elongated strip portion having its longitudinal ends integrally attached to its respective one of said third pair of parallel spaced wall sections and a central unsupported portion projected toward the inside of said casing while crossing directly over the corresponding louver opening, whereby when said casing is heated, the third pair of parallel spaced louvered wall sections will tend to curve due to expansion forces toward the inside of said casing.

* * * * *